US012540005B2

(12) United States Patent
Nágel et al.

(10) Patent No.: US 12,540,005 B2
(45) Date of Patent: Feb. 3, 2026

(54) RESEALABLE CAN LIDS FOR METAL BEVERAGE CANS

(71) Applicants: Tamás Nágel, Budapest (HU); Tamás Pájer, Bonyhád-Majos (HU); György Urgyán, Ülló (HU); Sándor Zsolt Köszegi, Tordas (HU)

(72) Inventors: Tamás Nágel, Budapest (HU); Tamás Pájer, Bonyhád-Majos (HU)

( * ) Notice: Subject to any disclaimer, the term of this patent is extended or adjusted under 35 U.S.C. 154(b) by 34 days.

(21) Appl. No.: 18/700,607

(22) PCT Filed: Feb. 22, 2022

(86) PCT No.: PCT/HU2022/050013
§ 371 (c)(1),
(2) Date: Apr. 11, 2024

(87) PCT Pub. No.: WO2023/062395
PCT Pub. Date: Apr. 20, 2023

(65) Prior Publication Data

US 2024/0409268 A1 Dec. 12, 2024

(30) Foreign Application Priority Data

Oct. 12, 2021 (HU) ..... 2100352

(51) Int. Cl.
*B65D 17/28* (2006.01)

(52) U.S. Cl.
CPC .. *B65D 17/4014* (2018.01); *B65D 2517/0041* (2013.01)

(58) Field of Classification Search
CPC ..... B65D 17/4011; B65D 17/4014; B65D 17/4012; B65D 17/401; B65D 51/007; B65D 51/18; B65D 2517/0014; B65D 2517/0041; B65D 2517/004; B65D 2517/0022
(Continued)

(56) References Cited

U.S. PATENT DOCUMENTS 538,092 A * 4/1895 Wanner, Jr. ..... B65D 47/265 220/259.2
4,122,970 A * 10/1978 Amabili ..... B65D 17/28 220/259.2
(Continued)

FOREIGN PATENT DOCUMENTS

CA 2728443 A1 * 1/2010 ..... B65D 17/4014
WO WO-9727117 A1 * 7/1997 ..... B65D 17/4014

*Primary Examiner* — Robert J Hicks
(74) *Attorney, Agent, or Firm* — Olson & Cepuritis, Ltd.

(57) ABSTRACT

A can lid comprises a base having a weakened contour defining a tear portion, wherein the base comprises a flange, with a rivet at the center of the base, and with an opening tab attached to the rivet structure. Rotatable bottom and top lids are secured to the rivet structure. An external curved guide rim in the bottom lid is slidably fitted in a circumferential bottom groove of the flange, and an external curved guide rim of the top lid is fitted slidably in a circumferential top groove of the flange of the base. The lids are adapted to rotate about the rivet structure independent of each other. Both lids comprises a protrusion disposed in a direction opposite the side of each lid that faces the base. The protrusions of the lids fit tightly against each other when the lids are in an identical position.

12 Claims, 4 Drawing Sheets

(58) Field of Classification Search
USPC .... 220/269, 270, 272, 273, 268, 266, 259.2, 220/259.3, 259.4, 703, 254.6, 254.3, 220/254.2, 254.1, 212
See application file for complete search history.

(56) References Cited

U.S. PATENT DOCUMENTS

| | | | | | |
|---|---|---|---|---|---|
| 5,269,432 | A * | 12/1993 | Beckertgis | B65D 51/24 | 215/250 |
| 6,059,137 | A * | 5/2000 | Westwood | B65D 17/4014 | 220/269 |
| 8,770,425 | B2 * | 7/2014 | Schley | B65D 17/4014 | 220/254.1 |
| 2006/0249511 | A1 * | 11/2006 | Yaffe | B65D 17/4014 | 220/254.1 |
| 2009/0057315 | A1 * | 3/2009 | Stringfield | B65D 81/3211 | 239/10 |
| 2012/0199586 | A1 * | 8/2012 | Shamalta | B65D 17/4012 | 220/269 |
| 2020/0262621 | A1 * | 8/2020 | Savenok | B65D 43/0212 | |
| 2020/0407109 | A1 * | 12/2020 | Vinger | B65D 17/34 | |
| 2021/0394956 | A1 * | 12/2021 | Latos | B65D 17/4014 | |
| 2022/0396394 | A1 * | 12/2022 | Stengel, Jr. | B65D 17/4014 | |
| 2023/0382593 | A1 * | 11/2023 | Stengel, Jr. | B65D 17/401 | |

* cited by examiner

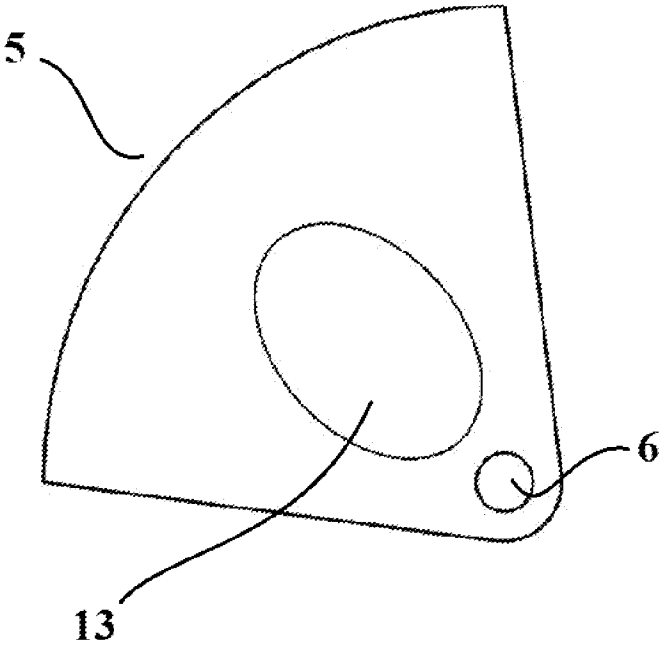
Fig. 5.b
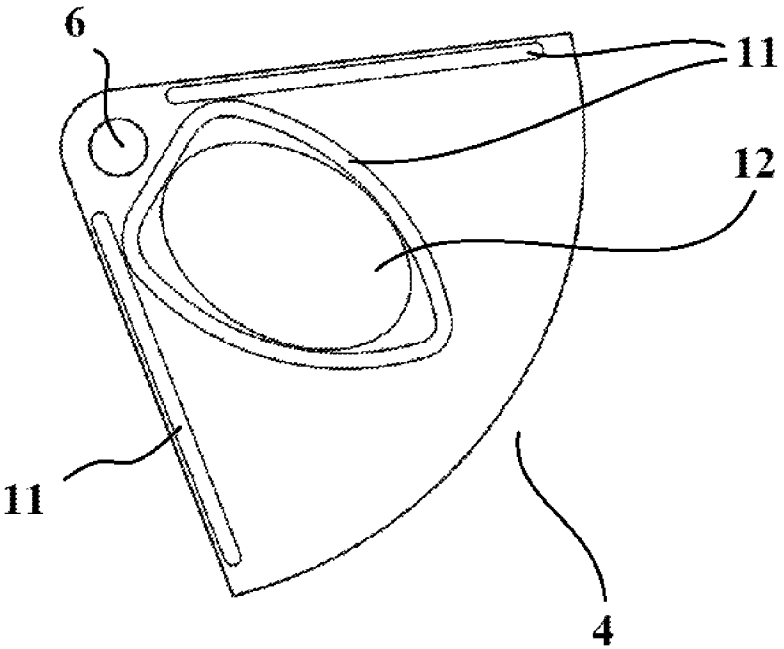
Fig. 5.a

RESEALABLE CAN LIDS FOR METAL BEVERAGE CANS

CROSS-REFERENCE TO RELATED APPLICATIONS

This application is a U.S. National Stage of PCT/HU2022/050013, filed Feb. 22, 2022, which claims priority to Hungarian Application No. P2100352, filed Oct. 12, 2021, each of which are incorporated herein by reference.

TECHNICAL FIELD

This patent application relates to a can lid for a beverage can made from thin sheet material, the can lid comprising a base and a rivet structure disposed at the centre of the base, with an opening tab and rotatable lids being secured to the rivet structure.

BACKGROUND ART

Cylindrical containers (cans) made of thin sheet material have long been applied for packaging beverages. Compared with earlier technical solutions, such cans have several advantages, including having small size and mass, being easy openable and easily recycled.

The most widespread opening process of such beverage cans involves lifting an auxiliary tab attached to the can, as a result of which, under the force acting on the can lid the material is torn along a weakened contour, allowing access to the contents of the can through the opening created in such a manner. The prior art document with publication number WO2012112487 A1 also discloses such a technical solution.

However, such solutions do not allow for reclosing (re-sealing) of the interior of the can, so the beverage contained therein cannot be isolated from outside effects, for example dust, insects, or prevented from splashing out.

A possible solution addressing these problems is disclosed in Hungarian utility model No. 4647, which discloses an isolating can lid having a rotatable lid, with an opening tab being attached to the can lid by means of a rivet structure, and with a score line being formed on the can lid. A further characteristic feature of the solution is that the rivet structure is disposed at the centre of the can lid, with a rotatable lid member being rotatably attached to the rivet structure, the rotatable lid member having a curved guide rim adapted to fit in the recess of the can lid, the surface area of the rotatable lid member being maximum 80% of the can lid, and with the opening tab being attached to the rivet structure above the rotatable lid member.

A disadvantage of the technical solution according to the utility model is that the rotatable lid adapted for resealing the can easily comes loose when it is rotated repeatedly, with the seal optionally disposed thereon wearing off easily, which results in that a waterproof seal can no longer be provided, even before the contents of the can is fully consumed, i.e., the can deteriorates prematurely.

A further drawback of prior art technical solutions, in addition to limited reclosability, is that in such cases it is uncertain that the closure can handle the overpressure caused by carbon dioxide contained therein (increased by shaking the can).

OBJECTIVE OF THE INVENTION

The objective of the invention is to provide such a resealable can lid for a can made of thin sheet material that eliminates the drawbacks of the prior art technical solutions, thereby preventing the premature deterioration of the can and providing the waterproof reclosing of the can, even over a prolonged period of time.

The objective of the invention is realized based on the recognition that a more complex mechanism comprising two closure lids is capable of bringing about stronger sealing in such a way that the compressive force required for providing the watertight sealing of the can lid is only provided to the rotatable lid when the lid is situated above the opening. This solution allows that the force required for watertight sealing and the integrity of the seal can both be ensured at the position and time where and when they are needed, without causing a premature deterioration of the watertight seal due to wear-off.

The objective of the invention is realized by providing a can lid comprising a base having a weakened contour defining a tear portion, wherein the base comprises a flange, with a rivet structure being arranged at the centre of the base, and with an opening tab being attached to the rivet structure. A bottom rotatable lid and a top rotatable lid are secured to the rivet structure, where an external curved guide rim of the bottom rotatable lid is fitted slidably in a circumferential bottom groove of the flange of the base, and where an external curved guide rim of the top rotatable lid is fitted slidably in a circumferential top groove of the flange of the base, with the bottom rotatable lid and the top rotatable lid being adapted to be rotated about the rivet structure independent of each other; and where the bottom rotatable lid comprises a protrusion disposed in a direction opposite its side facing the base, with the top rotatable lid comprising another protrusion at its side facing the base, where the protrusion of the bottom rotatable lid and the protrusion of the top rotatable lid fitting tightly against each other when the rotatable lids are in an identical position.

In a preferred embodiment of the can lid according to the invention the protrusion of the bottom rotatable lid and the protrusion of the top rotatable lid are formed by embossing the material of the lid.

In a further preferred embodiment of the can lid according to the invention the external curved guide rim of the bottom rotatable lid and/or the top rotatable lid extends along at most 50%, preferably at most 33%, more preferably 25% of the circumference of the flange.

In another preferred embodiment of the can lid according to the invention a respective stop members is disposed in the circumferential bottom groove and top groove of the flange of the base, said stop members being positioned angularly shifted with respect to each other.

In another preferred embodiment of the can lid according to the invention the bottom rotatable lid comprises a sealing strip that is disposed along the edges thereof and/or is arranged to correspond to the shape of the tear line defined on the base, and is adapted to be in contact with the base.

In a further preferred embodiment of the can lid according to the invention the sealing strip is made of a silicone material.

In a still further preferred embodiment of the can lid according to the invention the bottom rotatable lid and/or the top rotatable lid comprises a surface pattern, for example Braille script or other embossed pattern, adapted to facilitate the rotation and recognition of the lid.

BRIEF DESCRIPTION OF THE DRAWINGS

The preferred embodiments of the technical solution according to the invention are explained below referring to the accompanying drawings, where FIG. 5*a* is an underside view of the bottom rotatable lid of the can lid, and FIG. 5*b* is an underside view of the top rotatable lid of the can lid.

DESCRIPTION OF PREFERRED EMBODIMENTS

Figure 1:
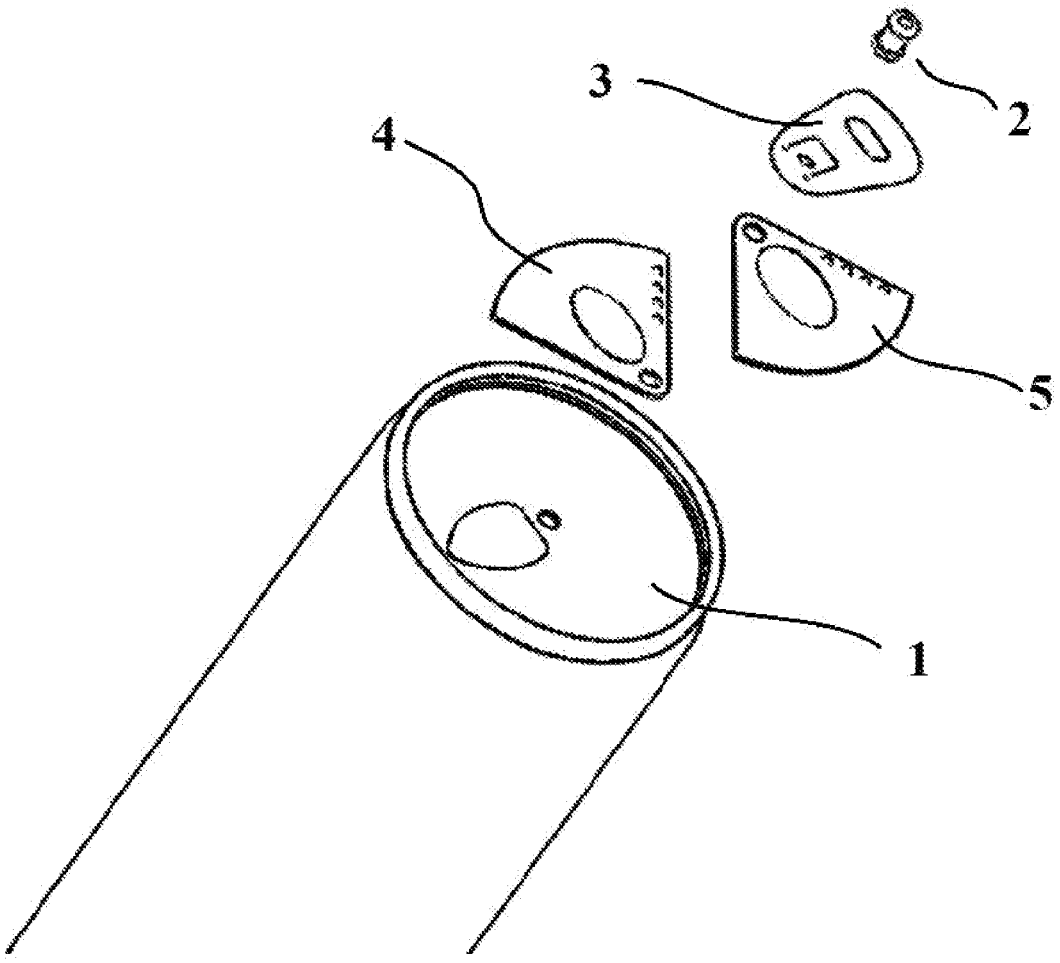
FIG. 1 is an exploded drawing of a beverage can, showing the major components of the can lid according to the invention.

FIG. 1 illustrates a preferred embodiment of the can lid in exploded view, showing the major components of the can lid. The can lid comprises a base 1 to which a bottom rotatable lid 4, a top rotatable lid 5, and an opening tab 3 are secured by means of a rivet structure 2.

Figure 2:
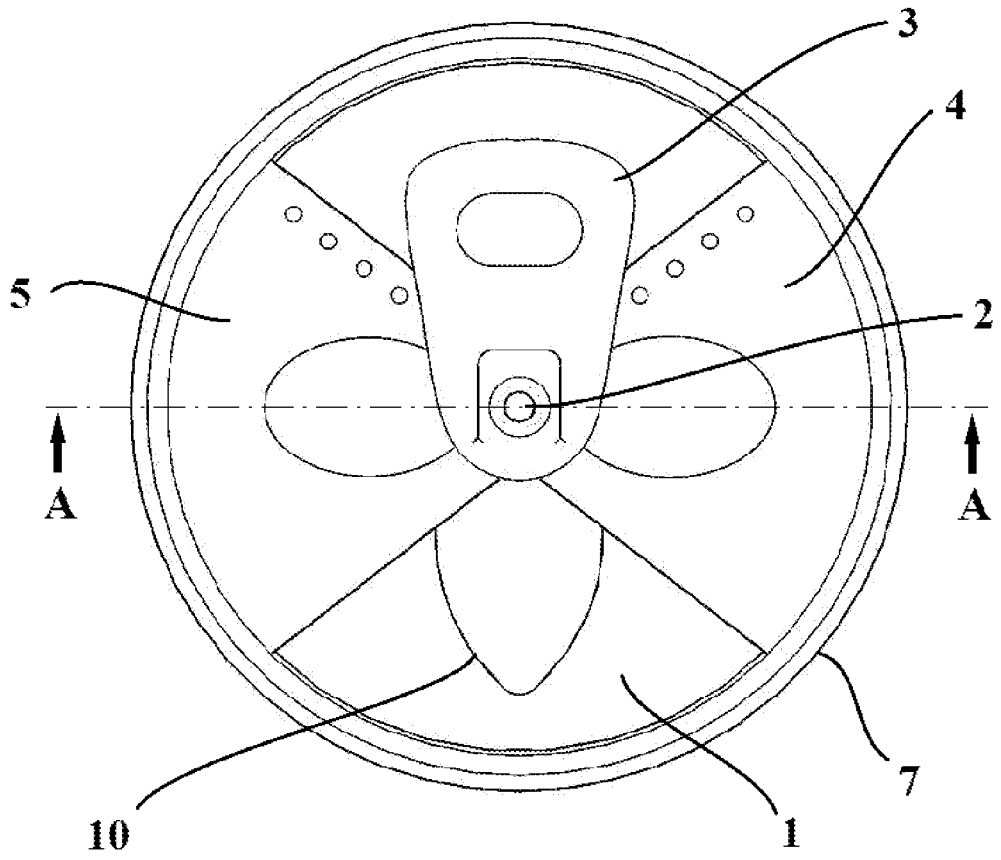
FIG. 2 is the top plan view of a preferred embodiment of the can lid according to the invention.

In FIG. 2 a top plan view of the can lid is shown, illustrating that a weakened contour 10 defining a tear portion is disposed on the base 1. The rivet structure 2 is arranged at the centre of the base 1, with the bottom rotatable lid 4, the top rotatable lid 5, and the opening tab 3 being arranged at increasing distance from the base 1 in a direction perpendicular to the base 1.

The opening tab 3 is configured in line with the state of the art, in a tiltable manner, according to one of the known technical solutions; i.e., it is adapted to tear an opening in the can lid along the tear line by applying force to the surface region bounded by the weakened contour 10, thus allowing access to the contents of the can.

Figure 3:
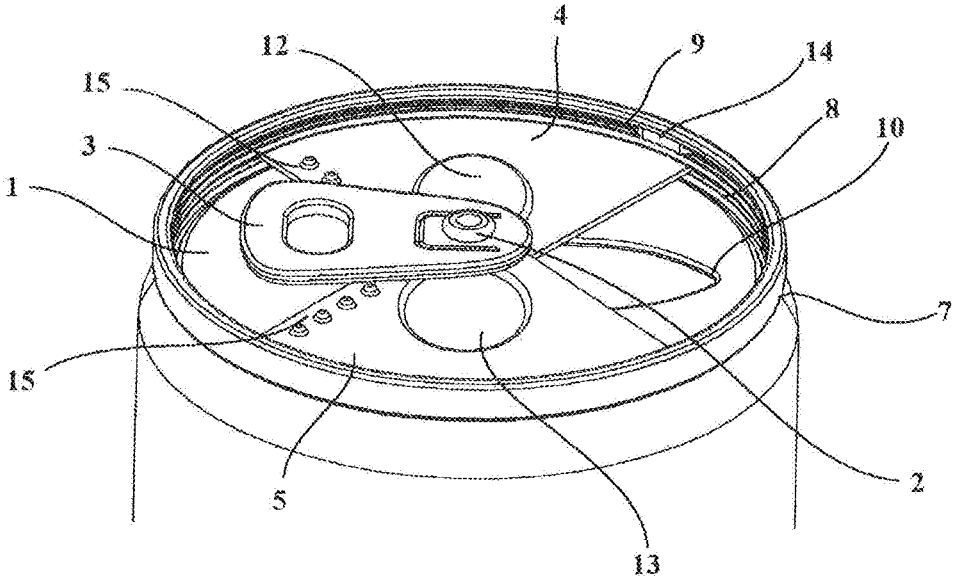
FIG. 3 is a perspective view of the can lid according to FIG. 2.

As can be seen also in FIG. 3, the base 1 comprises a flange 7 that has a bottom groove 8 and a top groove 9 disposed on its inside face. The two grooves can be formed during the manufacturing of the can lid blank, or even when the can lid is placed on the can, for example by stamping of the base 1, or also post-manufacturing, applying other machining or cutting processes, or optionally by fitting an additional intermediate flange to the base.

The bottom rotatable lid 4 and the top rotatable lid 5 arranged on the rivet structure 2 are adapted to be rotatable about the rivet structure 2, such that they are slidably secured in the bottom groove 8 and the top groove 9 disposed on the flange 7 of the base 1, and that the rivet structure 2 disposed at the centre of the base 1 extends through the bores 6 of the bottom rotatable lid 4 and the top rotatable lid 5. (The bores 6 can be seen in FIGS. 5*a* and 5*b*.)

A respective stop member 14 is disposed in the bottom groove 8 and the top groove 9, the stop members 14 being configured such that they block the travel of the flanges of the bottom rotatable lid 4 and the top rotatable lid 5 running in the grooves at respective predetermined close positions, and optionally also secure them at their predetermined respective close position. By a "predetermined close position" such a position is meant wherein the region bounded by the weakened contour 10 defining the tear portion of the base 1 is fully covered by the bottom rotatable lid 4 and/or the top rotatable lid 5 such that the lids preferably overextend the region bounded by the weakened contour 10 in every direction.

The stop members are arranged in the grooves such that one of them, for example the bottom rotatable lid 4, can be brought into its close position in a clockwise direction, while the other, for example the top rotatable lid 5 can be brought into its close position in an opposite (for example, anti-clockwise) direction.

In the case of the preferred embodiment illustrated in the drawings, the stop members are preferably angularly shifted by 45° along the circumference of the flange 7 relative to the centreline of the opening defined by the tear line 10; however, the exact location of these stop members 14 may vary according to the rule described above, depending on the size of the rotatable lids 4 and 5.

The bottom rotatable lid 4 comprises a protrusion 12, for example an embossing, in the direction opposite the side facing the base 1, said protrusion being elevated from the plane of the bottom rotatable lid 4 by a predetermined amount. The top rotatable lid 5 comprises a similar protrusion 13 on its side facing the base 1.

Figure 4:
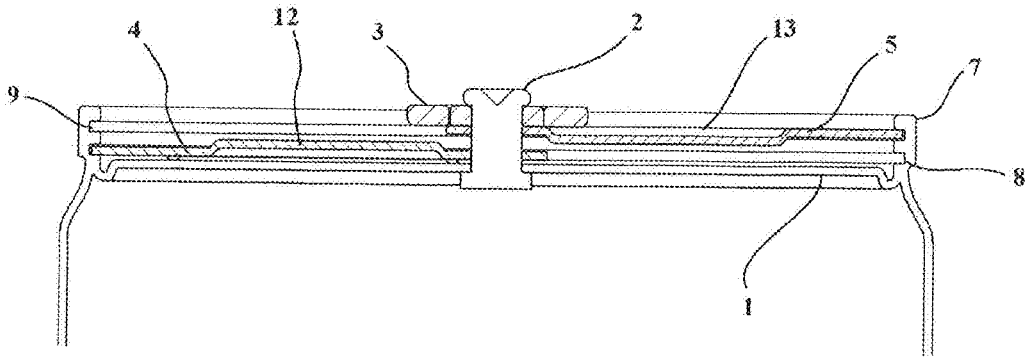
FIG. 4 is a sectional view taken along the line A-A indicated in FIG. 2.

As illustrated in FIG. 4, the protrusion 12 and the protrusion 13 are configured such that their combined height is substantially greater than or equal to the distance between the bottom guide groove 8 and the upper guide groove 9. Due to this, in the assembled state of the can lid, the bottom rotatable lid 4 and the top rotatable lid 5 are fitted tightly against each other if they are in an identical angular position.

The force generated by this tight (compressed) fit causes the bottom rotatable lid 4 and the top rotatable lid 5 to undergo a minimal extent of elastic deformation, as a result of which the bottom rotatable lid is fitted tightly against the base 1, which provides better sealing and closure.

However, the tight (compressed) fit thus produced can also be applied at an angular position that is different from that of the opening, in which case both lids can be secured against rotation at any position by the tightening force.

It is also shown by everyday experience that users do not always need a waterproof resealing of the can, i.e., a lid that covers the opening of the can such that insects, small objects and dust are prevented from entering the can be sufficient. In such a case it is sufficient to apply exclusively the bottom rotatable lid 4 or the top rotatable lid 5 in such a position that the opening defined by the tear line 10 can be covered.

In order that the bottom rotatable lid 4 and the top rotatable lid 5 can be easily rotated, the external curved guide rim of the lids 4, 5 extends along at most 50%, in an ideal and ergonomic embodiment, 20-30%, preferably for example 25% of the circumference of the flange 7.

Also for the sake of easier use, i.e., for facilitating the recognition of the lids by haptic sense and for making their rotation easier, the bottom rotatable lid 4 and/or the top rotatable lid 5 comprise a surface pattern, for example Braille script or embossing.

FIGS. 5*a* and 5*b* show underside views of the rotatable lids 4 and 5. To provide a watertight seal, the bottom rotatable lid 4 comprises sealing strips 11. As can be seen in FIG. 5*a*, the sealing strips are arranged along the lateral edges of the lids and, in the case of the bottom lid directly contacting the base 1, along a line corresponding to the shape of the weakened contour 10.

The sealing strips are preferably made of a silicone material, but can also be formed of other sealing materials acceptable for application in the food industry.

A great advantage of the invention is that it eliminates the drawbacks of prior art technical solutions by providing such a resealable can made of sheet material that provides improved sealing compared to existing solutions, prevents premature wear of the can, and provides a multifaceted sealing action that is in line with functionality.

Another great advantage of the technical solution according to the invention is that the closure brought about by a dual lid configuration provides improved sealing that is watertight and is resistant against mechanical shocks and pressure, so the can is sealed securely and the beverage contained in it retains its freshness and carbon dioxide content for a more prolonged time.

A further advantage of the technical solution is that the "hissing" opening sound that has been long familiar to consumers is retained when the lid configured according to the invention is utilized, so the comfortable, familiar feeling of using the existing solutions does not disappear, while the inventive solution can be realized in a cost-effective and economical manner.

An advantageous feature of the technical solution according to the invention is that, in addition to providing watertight sealing, the solution comprising rotatable seals provides other hygiene-related advantages, for example that the "drinking surface" of the can is regularly wiped and thus kept clean, and that aerosol-transmitted bacteria and viruses are kept away from the interior of the can.

LIST OF REFERENCE NUMERALS

1—base
2—rivet structure
3—opening tab
4—bottom rotatable lid
5—top rotatable lid
6—bore
7—flange
8—bottom guide groove
9—upper guide groove
10—weakened contour
11—sealing strips
12—protrusion
13—protrusion
14—stop member
15—surface pattern

The invention claimed is:

1. Can lid comprising a base (1) having a weakened contour (10) defining a tear portion, the base (1) comprises a circumferential flange (7), with a rivet structure (2) being arranged at the centre of the base (1), and with an opening tab (3) being attached to the rivet structure (2), characterised in that a bottom rotatable lid (4) and a top rotatable lid (5) are secured to the rivet structure (2), where an external curved guide rim of the bottom rotatable lid (4) is slidably received in a circumferential bottom groove (8) of the flange (7) of the base (1), and where an external curved guide rim of the top rotatable lid (5) is slidably received in a circumferential top groove (9) of the flange (7) of the base (1), with the bottom rotatable lid (4) and the top rotatable lid (5) being adapted to be rotated about the rivet structure independent of each other; and in that the bottom rotatable lid (4) comprises a first protrusion (12) disposed on its side facing away from the base, the top rotatable lid (5) comprises a second protrusion (13) on its side facing the base, and where the first protrusion (12) of the bottom rotatable lid (4) and the second protrusion (13) of the top rotatable lid (5) abut tightly against each other when said rotatable lids are in a fully overlapping position.

2. The can lid according to claim 1, characterised in that the external curved guide rim of the bottom rotatable lid (4) and the top rotatable lid (5) extend along at most 50% of the circumference of the flange (7).

3. The can lid according to claim 2, characterised in that the protrusion (12) of the bottom rotatable lid (4) and the protrusion (13) of the top rotatable lid (5) are embossments.

4. The can lid according to claim 1, characterised in that stop members (14) are disposed in the circumferential bottom groove (8) and the circumferential top groove (9) of the flange (7) of the base (1), the said stop members (14) being positioned angularly shifted with respect to each other.

5. The can lid according to claim 1, characterised in that the bottom rotatable lid (4) is provided with a sealing strip (11) in sealing contact with the base (1) and disposed along straight edges of the bottom rotatable lid (4).

6. The can lid according to claim 5, characterised in that the sealing strip (11) is a silicone material.

7. The can lid according to claim 1, characterised in that the bottom rotatable lid (4) and the top rotatable lid (5) have a surface pattern adapted to facilitate rotation and haptic recognition thereof.

8. The can lid according to claim 1, characterised in that the external curved guide rim of the bottom rotatable lid (4) and the external curved guide rim of the top rotatable lid (5) extend along at most 33% of the circumference of the flange (7).

9. The can lid according to claim 1, characterised in that the external guide rim of the bottom rotatable lid (4) and external guide rim of the top rotatable lid (5) extend along about 25% of the circumference of the flange (7).

10. The can lid according to claim 1, characterised in that the bottom rotatable lid (4) on a surface thereof facing the base (1) has a closed loop sealing strip in sealing contact with the base (1) and sized to surround the weakened contour (10) in the base (1) when positioned over the weakened contour (10).

11. The can lid according to claim 3, characterised in that said embossments extend toward one another and together provide a seal over an opening in the can lid defined by the weakened contour (10).

12. The can lid according to claim 1, characterised in that at least one of said bottom rotatable lid (4) and said top rotatable lid (5) has a surface pattern adapted to facilitate rotation and haptic recognition thereof.

* * * * *